United States Patent [19]

Orme

[11] 4,351,357

[45] Sep. 28, 1982

[54] FAIL SAFE COMPENSATOR USED IN A HYDRAULIC SERVO CONTROL SYSTEM

[75] Inventor: Myrl E. Orme, Canoga Park, Calif.

[73] Assignee: The Bendix Corporation, North Hollywood, Calif.

[21] Appl. No.: 248,611

[22] Filed: Mar. 27, 1981

[51] Int. Cl.[3] ..... F15B 1/02

[52] U.S. Cl. ..... 137/446; 60/413

[58] Field of Search ..... 91/5, 446; 60/413; 137/596.2; 244/226

[56] References Cited

U.S. PATENT DOCUMENTS

| | | | |
|---|---|---|---|
| 2,366,382 | 1/1945 | Burton | 91/446 X |
| 3,188,916 | 6/1965 | Beatty | 91/446 X |
| 4,197,785 | 4/1980 | Weber | 91/446 X |

*Primary Examiner*—Robert G. Nilson

*Attorney, Agent, or Firm*—Robert C. Smith; William F. Thornton

[57] ABSTRACT

A compensator for use with a hydraulic control valve connected to a source of high fluid pressure provides the functions of a low pressure return line accumulator and controllable check valve. A spring loaded piston (66) in a housing (64) has a working face exposed to fluid pressure downstream of the power control unit (10). A poppet valve (80) movable in a bore (78) on the axis of the piston is spring loaded against a seat (82) in the return line (40, 42) to interrupt flow between the downstream side of the power control unit (10) and the return side of the fluid pressure source. When normal return line pressure is sensed, the piston (66) moves against its spring (68) to permit the housing (64) to be substantially filled with fluid. Further increases in fluid pressure cause the piston (66) to contact and open the poppet (80) and permit flow to the return side (42) of the fluid pressure source. A working area (92) is formed on a part of the poppet (80) to the outside of the seat which area is exposed to the fluid pressure downstream of the power control unit (10). Should the piston (66) stick or seize in the housing (64), the fluid pressure acting against this working area (92) would increase to some value significantly above the normal pressure at which point it becomes sufficient to open the poppet (80), thus preventing the power control unit (10) from jamming or becoming hydraulically locked in position.

9 Claims, 2 Drawing Figures

FAIL SAFE COMPENSATOR USED IN A HYDRAULIC SERVO CONTROL SYSTEM

Figure 1:
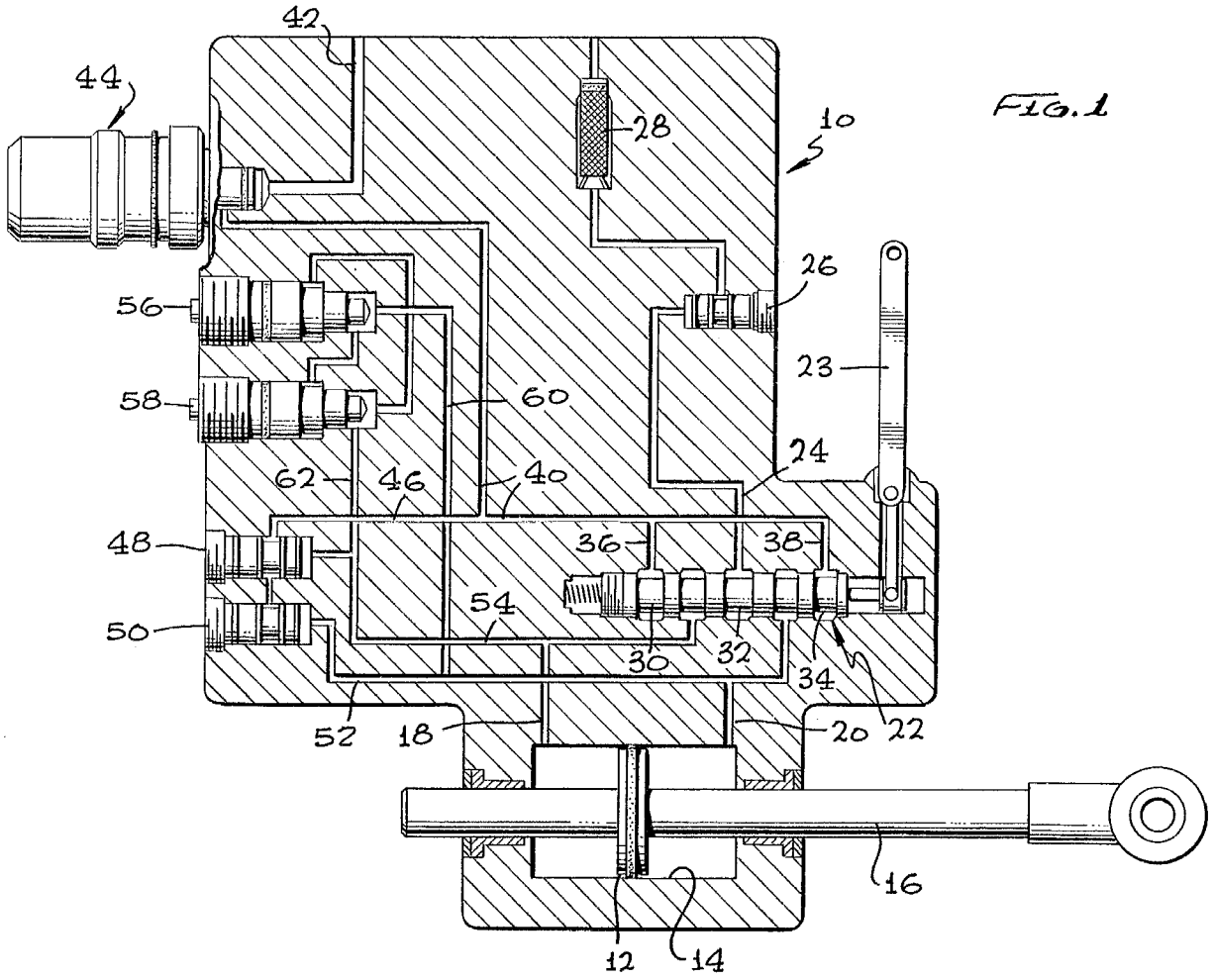

This invention relates to a fail-safe compensator used in a hydraulic servo control system including a hydraulic motor or actuator whose position or force is controlled by means of a servo valve having connections to both high pressure and low pressure sources of hydraulic fluid. The compensator is connected in the line between the low fluid pressure source and the servo valve and serves as an accumulator and controllable check valve. The purpose of the compensator is to keep the servo valve (power control unit) full of fluid at all times. Thus, where the actuator is connected to aircraft control surfaces such as ailerons or elevators, the compensator eliminates control surface droop when the aircraft is on the ground and also lets the actuator serve as a control surface damper when the aircraft is in flight if, for any reason, the hydraulic power has been removed from the actuator.

Because of the application of such hydraulic servo control systems to commercial aircraft, it is necessary that they be made as safe as reasonably possible. In general, it is desired that all possible failure modes be evaluated and that none be able to produce a catastrophic failure, such as might be represented by any malfunction resulting in moving the servo valve to produce a locked "hard over" position of the control surfaces. While it is possible for the prior art compensator described above to experience failures in certain modes, it is highly reliable, particularly since the previously known and understood failure modes result in no effect more serious than opening of the fluid conduit through the compensator which would permit the control surfaces to droop when the hydraulic power has been removed from the servo valve. Some possible failure modes would also eliminate the damping function described above, but none are catastrophic in the sense that they would cause the aircraft to crash or even become substantially more difficult to control.

The compensator consists of a cylinder containing a spring-loaded piston exposed to the pressure in the fluid conduit downstream of the actuator. When the normal operating pressure is placed on the actuator, the pressure in the fluid conduit moves the piston against the force of the spring and fills the compensator, thus trapping a quantity of the actuating fluid in the compensator housing. A spring-loaded poppet-type check valve which forms part of the compensator closes on a seat forming part of the fluid conduit unless the compensator is substantially full, in which case the piston moves to a position where slight fluid pressure increases cause it to periodically dislodge the check valve from its seat, thereby controlling the pressure on the downstream side of the actuator and permitting a limited amount of operating fluid to flow to the return side of the supply source. Thus the compensator maintains a certain desired downstream pressure on the actuator and holds this pressure even though the supply pressure is removed.

One possible failure mode of the compensator which, while it hasn't been experienced in actual flight operations, is at least theoretically possible involves sticking of the piston in the cylinder. An analysis indicates that this type of failure could be more serious than those previously studied in that it could result in immobilizing or "jamming" the actuator by blocking all flow between the actuator and the return fluid pressure source.

This invention contemplates modification of the compensator described above to incorporate an additional relief valve function by forming on the poppet valve member an operating area between its outside diameter and the diameter of the seat which is exposed to the fluid pressure in the conduit between itself and the actuator. The back side of the poppet is exposed to the return fluid pressure source. In the event the piston were to stick in its housing, the return pressure from the actuator would tend to build up to a pressure substantially greater than normal until it reaches a value where it is sufficient, acting against the above described operating area, to force the poppet off its seat and thereby permit flow to return from the actuator to the low pressure source. In this manner the compensator becomes fail-safe because "jamming" or immobilizing of the actuator cannot occur even by a failure where the piston becomes stuck or seized to the housing.

Thus it is an object of the present invention to provide a structure which causes the above described compensator to be fail-safe for all recognized failure modes, particularly including possible seizing of the piston in the housing.

Another object of the present invention is to provide a relief valve for use with the said compensator wherein modifications required to render the compensator fail-safe even against sticking of the piston in the housing are relatively slight and inexpensive.

Figure 2:
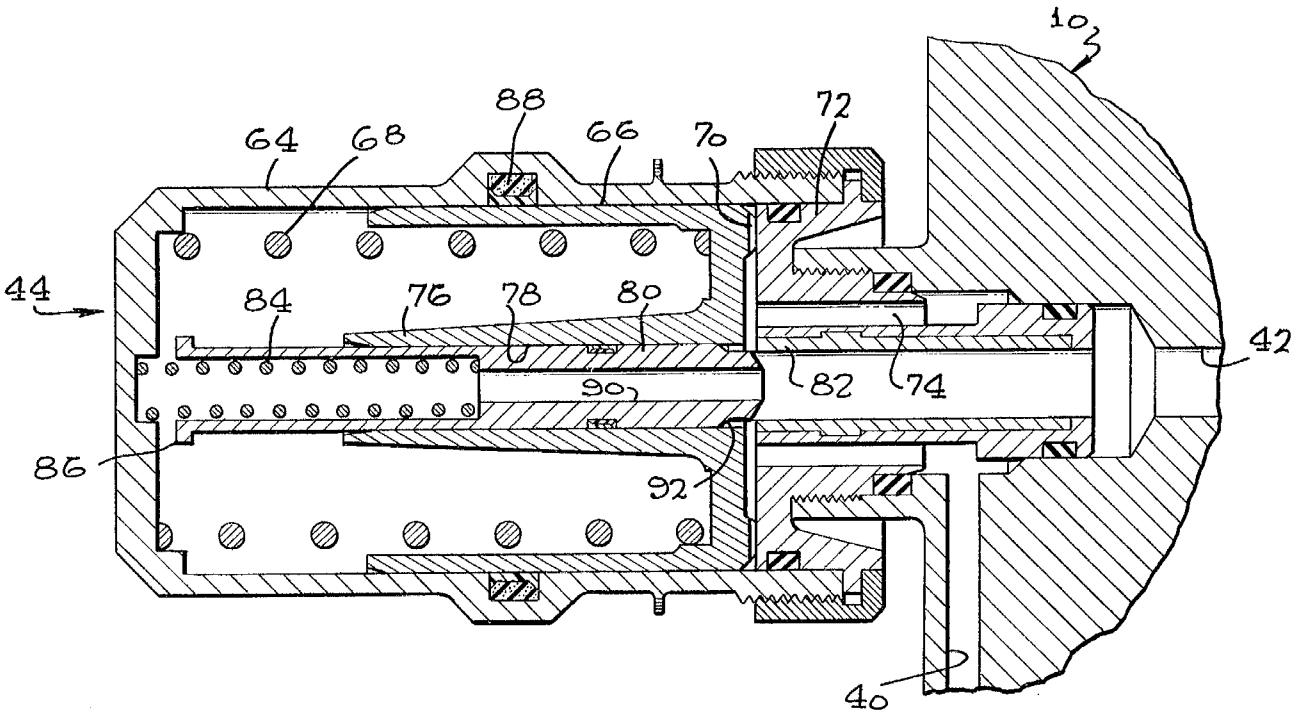

FIG. 1 is a schematic drawing showing the power control system including the actuator, servo valve and compensator; and FIG. 2 is a sectional drawing of a compensator for use with the above described power control unit.

Referring now to FIG. 1, the power control unit 10 includes a piston 12 in a cylinder 14. The piston drives a rod 16 which is attached to suitable linkage means for controlling the position of a control surface (not shown). Operably connected to the cylinder 14 through a pair of fluid conduits 18 and 20 is a servo valve 22 movable by means of a pilot's input lever 23 which valve on its inlet side is connected to a source of high fluid pressure through a conduit 24, an inlet check valve 26, and a filter 28. Servo valve 22 consists of a spool valve member having a plurality of lands 30, 32 and 34 which serve to direct flow from the high pressure source through conduit 24 to either conduit 20 or conduit 18 to move the piston 12 one way or another as desired. This control valve also includes return lines 36 and 38 which connect into a common line 40 connected to the aircraft return fluid source in line 42 through the compensator 44.

Connected to the return line 40 by means of a line 46 are a pair of anti-cavitation check valves 48 and 50. Valve 48 is connected through a conduit 54 to line 18 on one side of the piston 12 and valve 50 is connected through a line 52 to conduit 20 which communicates with the opposite side of piston 12. Each of lines 52 and 54 also connects with a pair of relief valves 56 and 58 through lines 60 and 62, respectively. Since the compensator 44 serves as an accumulator as well as a check valve, as indicated above, there is need for the anti-cavitation check valves 48 and 50 and the relief valves 56 and 58 which provide a portion of the damping function referred to above, as is understood in the art.

The compensator 44 is shown in an enlarged view in FIG. 2. The compensator consists of a housing 64 which is suitably attached to the power control unit 10 and has connections with fluid conduits 40 and 42 described above. Within housing 64 is a large piston 66 which is urged toward the right by means of a main spring 68. Piston 66 includes on its face a rim section 70 which spaces it away from an annular member 72 which includes a passageway 74 communicating the fluid pressure in conduit 40 with the face of piston 66. Piston 66 also includes a tubular center section 76 which contains an annular bore 78 located on the axis of piston 66 and which contains a poppet valve 80 which is urged toward the right onto a seat member 82 by means of a spring 84. Poppet 80 has a radially outwardly extending flange 86 which is aligned with tubular portion 76 of the piston in such manner that when piston 76 is moved almost full travel toward the left, this tubular portion will contact flange 86, thereby causing poppet 80 to leave seat 82. Leakage between piston 66 and housing 64 is limited by means of a seal 88. Poppet 80 includes a centrally located bore 90 which provides communication between the left side of piston 66 and the return pressure conduit 42. Between the outside diameter of poppet 80 and the diameter represented by the seat 82 is a working area 92 which is exposed to the pressure between the downstream side of the power control unit 10 and the compensator 44. When this pressure builds up to a sufficient level, as in the case of a piston 66 which is stuck to the housing 64, this pressure will force the poppet 80 to the left against the action of spring 84 and whatever fluid pressure is acting on the left-facing surfaces of poppet 80.

In normal operation the control valve is moved by means of the pilot's input lever 23 to cause the inlet pressure in line 24 to be directed to either one side or the other of piston 12. Fluid flowing in the return line 40 then increases to a value as established by the force of spring 68. As this pressure builds up the piston 66 moves to the left against the force of spring 68, thereby causing the housing 64 to fill with operating fluid. This fluid cannot initially flow out through conduit 42 because the poppet 80 is closed on its seat 82. When piston 66 moves to such distance that it makes contact with flange 86, the poppet 80 is then dislodged from seat 82, and operating fluid is permitted to flow through conduit 82 to the system return. In this manner, housing 64 will always contain a given amount of the operating fluid and thus serves partially as an accumulator. It also serves to maintain a desired downstream pressure in line 40, as will be understood by those skilled in the art. From the foregoing, it will be recognized that poppet 80 will normally remain on seat 82 except for those times when the tubular member 76 makes contact with flange 86 and dislodges the poppet from the seat to permit flow through conduit 42.

In the event piston 66 were to seize or stick to the housing 64, the pressure against the face of piston 66 will then build to a substantially higher value than is normally required to move this piston against the force of spring 68. At some point this pressure will be sufficient acting on working face 92 to force poppet 80 off of seat 82 and permit flow thereacross to the return fluid conduit 42. This pressure level may be substantially higher than that normally experienced in conduit 40, but operation of the poppet 80 as described will result in essentially normal operation of the control valve and actuator piston 12 except for the droop in the control surfaces which comes as a result of having no fluid in the housing 64 to act as an accumulator.

From the foregoing, it will be appreciated that the system described very simply and conveniently meets a requirement for fail-safe operation in the event of possible sticking of the piston to the housing of the compensator. It is recognized that the relief valve function provided by the control surface area 92 on poppet 80 could also be provided by means of a separate relief valve in parallel with the compensator; however, such additional valve would be significantly more expensive and less convenient to implement.

I claim:

1. A hydraulic system for controlling the position of a member including a hydraulic cylinder with a piston movable therein connected to said member, a control valve connected to a source of hydraulic fluid under high pressure and to a low pressure source and fluid conduits connecting said control valve to said sources and to both sides of said piston in said cylinder, and a compensator valve connected in a fluid conduit between said control valve and said low pressure source, said compensator valve including a housing, a piston in said housing urged in a first direction by the fluid return pressure on the low pressure side of said control valve, resilient means urging said piston in a second direction, a check valve in said housing, second resilient means urging said check valve in a position to close said fluid conduit, and means movable with said piston in response to a desired level of said fluid return pressure operable to contact said check valve and open said fluid conduit, characterized in that said check valve comprises a seat forming part of said fluid conduit and a poppet closing on said seat, the diameter of said seat being significantly less than the diameter of said poppet, a working area of said poppet between its outside diameter and the diameter of said seat being exposed to fluid return pressure such that, were said piston to stick in said housing, said fluid return pressure will increase to a value sufficient to force said poppet open against the force of said second resilient means.

2. A compensator valve as claimed in claim 1 wherein said seat is positioned coaxially with said piston and said poppet is carried within said piston and along its axis.

3. A compensator valve as claimed in claim 2 wherein said poppet is relatively axially movable within said piston and carries abutment means which is contacted when said piston moves in response to said desired level of fluid return pressure.

4. A compensator valve as claimed in claim 3 wherein said piston includes an elongated cylindrical guide carrying said poppet and slidable thereon contacting said abutment means to open said poppet.

5. A hydraulic system for controlling the position of a member including a hydraulic cylinder with a piston movable therein connected to said member, a source of hydraulic fluid under pressure, a low pressure return source of hydraulic fluid, a control valve, a plurality of fluid conduits connecting said control valve to said sources and to both sides of said piston, and a compensator valve connected in a fluid conduit between said control valve and said low pressure return source, said compensator valve including a housing, a piston in said housing dividing said housing into first and second chambers, said first chamber being exposed to the fluid return pressure on the low pressure side of said control valve, a spring in said second chamber opposing the force of said fluid return pressure, a check valve in said housing and a second spring urging said check valve in a direction to close said fluid conduit, said check valve being operatively connected to said piston such that when said piston moves in response to a predetermined level of said fluid return pressure, said check valve is opened to connect said fluid return pressure to said low pressure return source, characterized in that said check valve comprises a seat forming part of said fluid conduit and a poppet engageable with said seat, the diameter of said seat being significantly less than the diameter of said poppet, a working area of said poppet between its outside diameter and said seat being exposed to fluid return pressure such that, in the event said piston were to stick in said housing, said fluid return pressure would increase to a value substantially greater than said predetermined value to force said poppet open.

6. A compensator valve as claimed in claim 5 wherein said seat is positioned coaxially with said piston and said poppet is carried within said piston and along its axis.

7. A compensator valve as claimed in claim 6 wherein said poppet is relatively axially movable within said piston and carries abutment means which is contacted when said piston moves in response to said desired level of fluid return pressure.

8. A compensator valve as claimed in claim 7 wherein said piston includes an elongated cylindrical guide carrying said poppet and slidable thereover contacting said abutment means to open said poppet.

9. A compensator valve as claimed in claim 5 wherein said poppet includes an axial passageway smaller in diameter than said seat which communicates said second chamber with said low pressure return source.

* * * * *